US005433450A

United States Patent [19]

Vaillancourt

[11] Patent Number: 5,433,450

[45] Date of Patent: Jul. 18, 1995

[54] BOARD GAME

[76] Inventor: George Vaillancourt, 6 Bernice St., Hooksett, N.H. 03106-1402

[21] Appl. No.: 337,090

[22] Filed: Nov. 10, 1994

[51] Int. Cl.[6] ..... A63F 3/00

[52] U.S. Cl. ..... 273/248; 273/284

[58] Field of Search ..... 273/236, 243, 248, 282.1, 273/284, 287

[56] References Cited

U.S. PATENT DOCUMENTS

| | | | |
|---|---|---|---|
| D. 123,508 | 11/1940 | Moore | 273/248 X |
| D. 148,728 | 2/1948 | Smith et al. | 273/284 X |
| D. 209,598 | 12/1967 | Tharp | 273/287 X |
| 373,745 | 11/1887 | Le Seur | 273/284 |
| 2,320,184 | 5/1943 | Kramer | 273/284 |
| 3,148,886 | 9/1964 | Sharp | 273/287 |
| 3,166,325 | 1/1965 | First | 273/248 X |
| 3,236,522 | 2/1966 | Brown | 273/287 X |
| 3,395,922 | 8/1968 | Garangiotis | 273/248 |
| 4,556,213 | 12/1985 | Sharma | 273/284 X |
| 4,946,170 | 8/1990 | Mastro | 273/284 X |

FOREIGN PATENT DOCUMENTS

| | | | |
|---|---|---|---|
| 2670126 | 6/1992 | France | 273/287 |

*Primary Examiner*—William E. Stoll

[57] ABSTRACT

A board game comprising a plurality of sets of game pieces; a game board having a front surface and a back surface with each surface further having a circuitous path disposed thereon formed of a plurality of adjacent trails of an even number, each trail associated with a set of game pieces, each trail formed of a plurality of indentations beginning with an indentation designated as a starting space and with the remaining indentations numbered sequentially; a plurality of decks of playing cards; and a rule book describing rules of play.

16 Claims, 4 Drawing Sheets

BOARD GAME

BACKGROUND OF THE INVENTION

1. Field of the Invention

The present invention relates to a board game and more particularly pertains to allowing teams of two players to compete against each other with a board game.

2. Description of the Prior Art

The use of board games is known in the prior art. More specifically, board games heretofore devised and utilized for the purpose of allowing teams to compete against each other are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,638,948 to Smith discloses a chance-controlled marble game. U.S. Pat. No. 3,709,497 to Barlow discloses a marble type board game apparatus. U.S. Pat. No. 4,362,302 to Gardner discloses a board game utilizing playing cards. U.S. Pat. No. 5,129,649 to Scholz discloses a method of playing a board game. U.S. Pat. No. 5,201,524 to Csanady et al. discloses a board game.

While these devices fulfill their respective, particular objective and requirements, the aforementioned patents do not describe a board game that allows pairs of players to compete against each other utilizing a board with indentations disposed thereon, marbles, and two conventional decks of playing cards.

In this respect, the board game according to the present invention substantially departs from the conventional concepts and designs of the prior art, and in doing so provides an apparatus primarily developed for the purpose of allowing teams of two players to compete against each other.

Therefore, it can be appreciated that there exists a continuing need for new and improved board game which can be used for allowing teams of two players to compete against each other. In this regard, the present invention substantially fulfills this need.

SUMMARY OF THE INVENTION

In the view of the foregoing disadvantages inherent in the known types of board games now present in the prior art, the present invention provides an improved board game. As such, the general purpose of the present invention, which will be described. subsequently in greater detail, is to provide a new and improved board game and method which has all the advantages of the prior art and none of the disadvantages.

To attain this, the present invention essentially comprises, in combination, six sets of four game pieces. Each game piece is formed of a marble. The game pieces of a set have a characteristic color. Each set of game pieces has a unique color. A planar rigid game board is included and has a generally rectangular planar interior portion, a planar peripheral exterior portion formed of a pair of opposed spaced and generally rectangular long wings with rounded corners and a pair of opposed spaced and generally rectangular short wings with rounded corners with the wings integrally coupled about the interior portion and extended outwards therefrom to form a petaloid periphery, a front surface, and a back surface.

The front surface further includes a circuitous path disposed thereon formed of six elongated adjacent trails. Each trail is formed of thirty two spaced indentations having a characteristic color. The indentations of each trail are associated with a set of game pieces having the same characteristic color. The indentations of each trail are grouped into a travelable first part connected with travelable first parts of adjacent trails, a non-travelable second part, and a non-travelable third part. The first part is formed of twenty-four spaced indentations beginning with an indentation designated as a starting space and with the remaining indentations of the first part sequentially numbered from 1 to 23, respectively. The second part is formed of four indentations and designated as a holding area for game pieces of the associated set. The third part is formed of four indentations and designated as a home area for game pieces of the associated set. Each indentation of each trail is formed with a generally concave shape sized for removably holding a game piece therein. The back surface further includes a circuitous path disposed thereon formed of a even number of trails wherein the even number of trails on the back surface is less than the number of trails on the front surface.

A handle is included and formed of an elongated slot disposed through one of the primary wings of the game board for allowing the game board to be carried by hand. Two elongated grooves are included with one groove disposed on the front surface of the game board and the other groove disposed on the rear surface of the game board. Each groove is extended around the respective surface at a location adjacent to the periphery and generally enclosing the respective path. Each groove prevents game pieces from rolling off of the respective surface when game pieces are dislodged from an indentation during play. Two decks of playing cards are included. Each deck has fifty-four playing cards. The playing cards include four suits of hearts, diamonds, clubs, and spades and also include a pair of jokers. Each suit further has thirteen cards. Nine of the thirteen cards of the suit are sequentially numbered from 2 to 10, respectively. The remaining four cards of a suit are designated as a jack, a queen, a king, and an ace, respectively. Lastly, a rule book is included and describes rules of play for the board game.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved board game which has all the advantages of the prior art board games and none of the disadvantages.

It is another object of the present invention to provide a new and improved board game which may be easily and efficiently manufactured and marketed.

It is a further object of the present invention to provide a new and improved board game which is of durable and reliable construction.

An even further object of the present invention is to provide a new and improved board game which is susceptible of a low cost of manufacture with regard to both materials and labor, and which accordingly is then susceptible of low prices of sale to the consuming public, thereby making such a board game economically available to the buying public.

Still yet another object of the present invention is to provide a new and improved board game which provides in the apparatuses and methods of the prior art some of the advantages thereof, while simultaneously overcoming some of the disadvantages normally associated therewith.

Even still another object of the present invention is to provide a new and improved board game for allowing teams of two players to compete against each other.

Lastly, it is an object of the present invention to provide a new and improved board game comprising a plurality of sets of game pieces; a game board having a front surface and a back surface with each surface further having a circuitous path disposed thereon formed of a plurality of adjacent trails of an even number, each trail associated with a set of game pieces, each trail formed of a plurality of indentations beginning with an indentation designated as a starting space and with the remaining indentations numbered sequentially; a plurality of decks of playing cards; and a rule book describing rules of play for the board game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
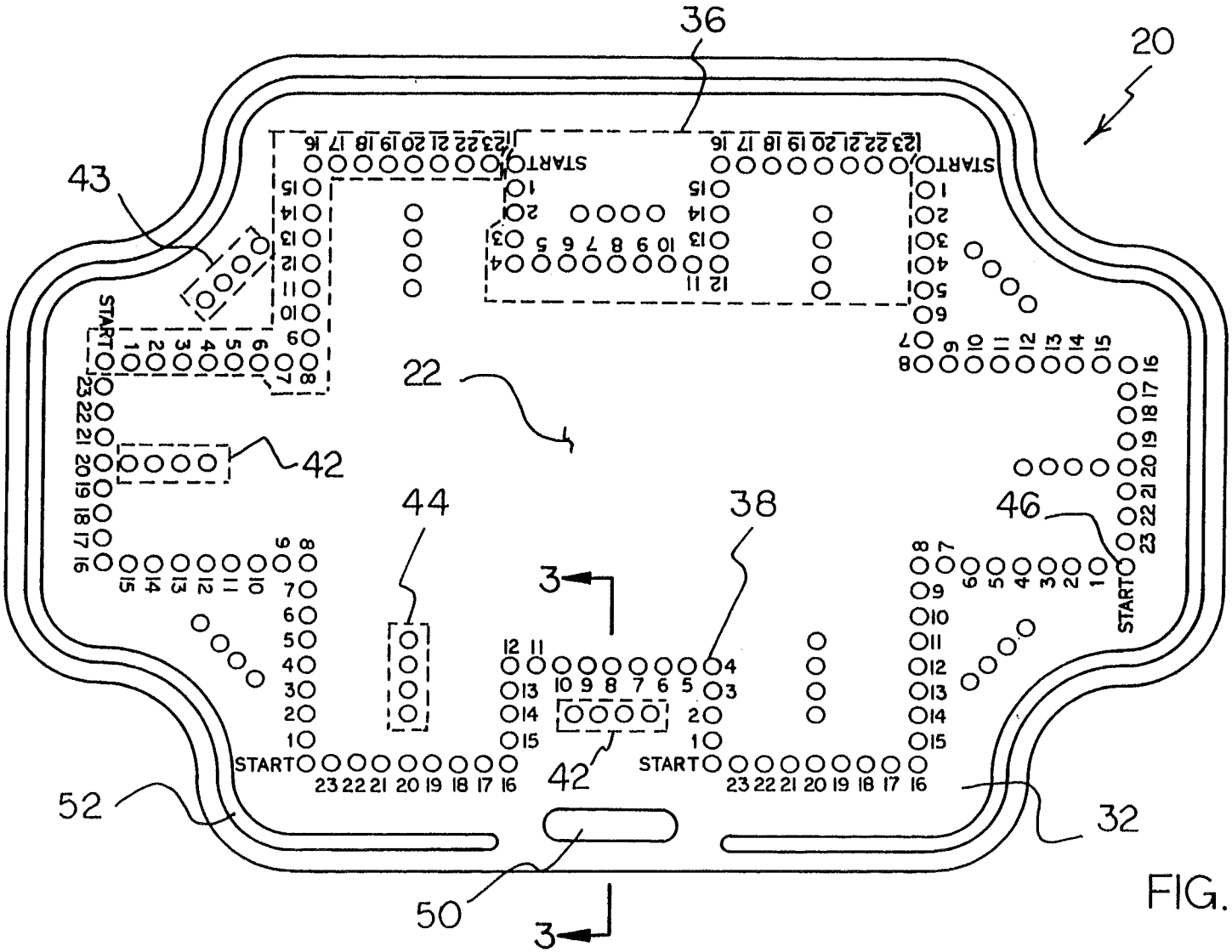
FIG. 1 is a plan view of the front surface of the game board.
Figure 2:
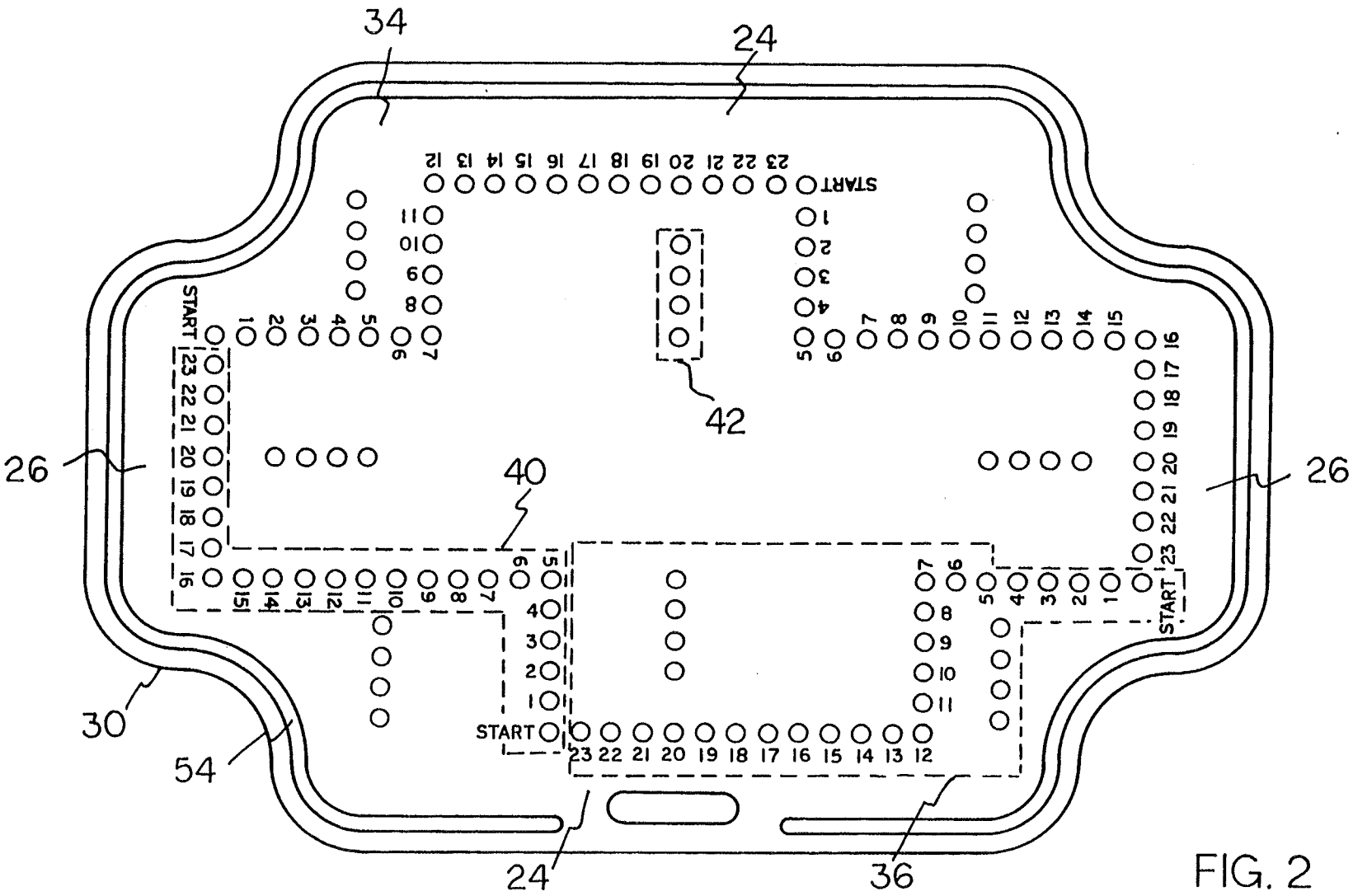
FIG. 2 is a plan view of the back surface of the game board.
Figure 3:
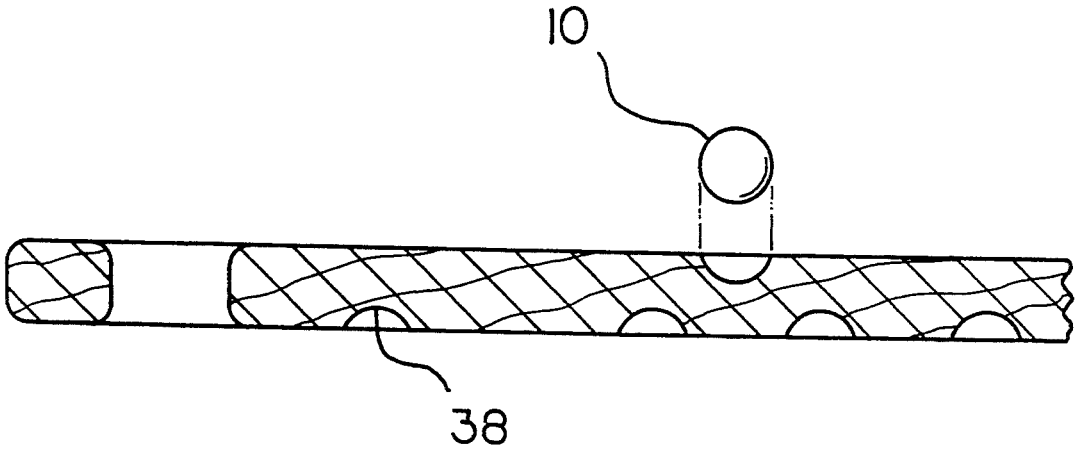
FIG. 3 is a cross-sectional view of the game board and its associative coupling with a game piece.
Figure 4:
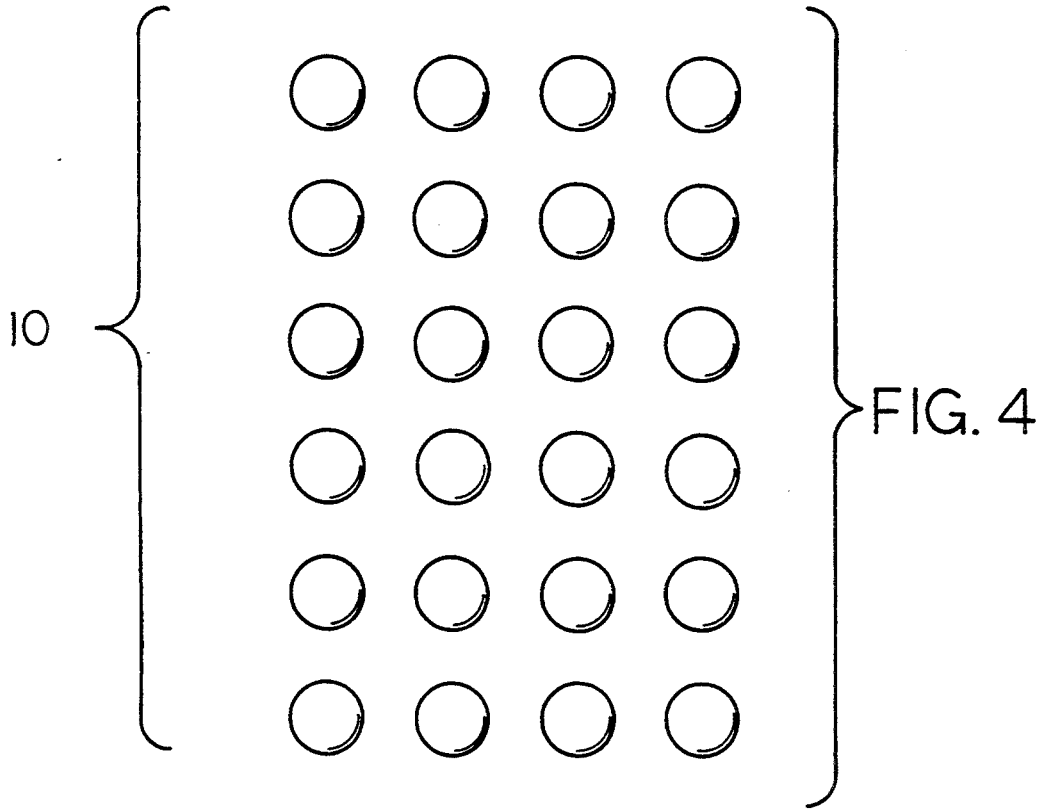
FIG. 4 is a plan view of the six sets of game pieces of the present invention.
Figure 5:
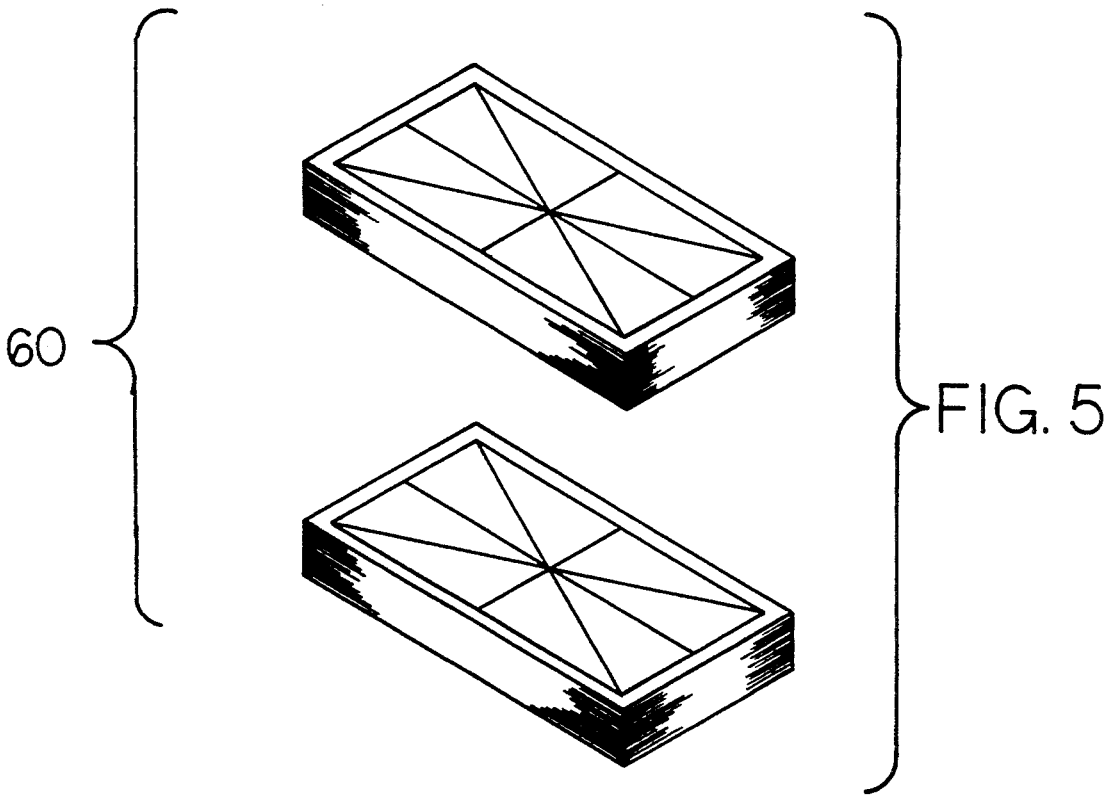
FIG. 5 is a perspective view of the two conventional decks of playing cards of the present invention.
Figure 6:
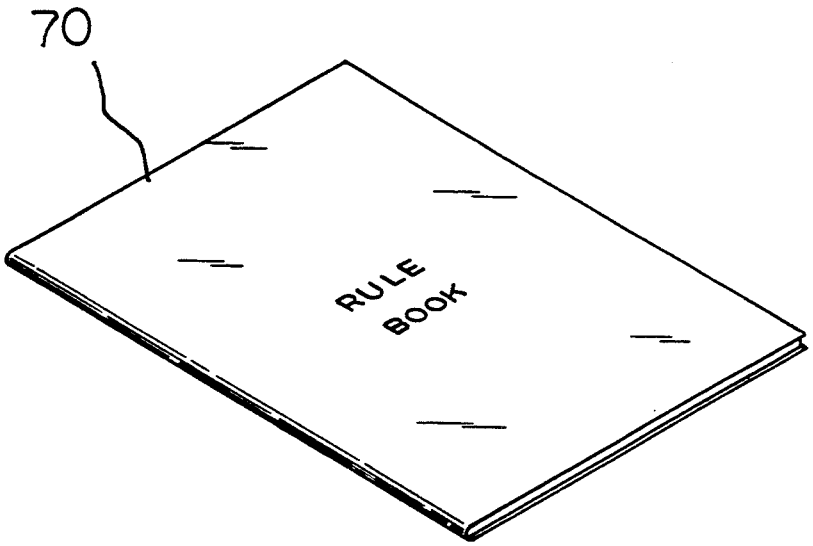
FIG. 6 is perspective view of the rule book of the present, invention describing rules of the board game.

With reference now to the drawings, the preferred embodiment of the new and improved board game embodying the principles and concepts of the present invention and generally designated by the reference numbers 10, 20, 60, and 70 will be described.

Specifically, the present invention essentially includes four major components. The major components are the game pieces, game board, decks of playing cards, and rule book. These components are interrelated to provide the intended function of allowing teams of two players to compete against each other.

More specifically, it will be noted in the various Figures that the first major component is the game pieces 10. The present invention includes six sets of game pieces. Each set contains four game pieces. Each game piece is formed of a spherical marble. The game pieces of a set have a characteristic color. Each set of game pieces has a unique color to distinguish them from game pieces of other sets.

The second major component is the game board 20. The game board is planar and rigid in structure. In the preferred embodiment, the game board is formed of plywood with a polyurethane finish. The game board has a generally rectangular planar interior portion 22. The game board also has a planar peripheral exterior portion integral with and formed around the interior portion. The exterior portion is formed of a pair of opposed, spaced, and generally rectangular long wings 24 having rounded exterior corners and a pair of opposed, spaced, and generally rectangular short wings 26 having rounded exterior corners. The long wings and short wings are integrally coupled about the interior portion and extended outwards therefrom in the same plane to form a petaloid periphery 30, a front surface 32, and a back surface 34.

The front surface further includes a circuitous path disposed thereon in a general oval-type configuration. This path is formed of six elongated adjacent trails 36 disposed on the front surface of the game board in a general end-to-end configuration. The trails on the front surface accommodate play by six players or three teams. Each trail is formed of thirty-two spaced indentations 38. These indentations have a characteristic color and are associated with a set of game pieces 10 having the same characteristic color. The indentations of each trail on the front surface are grouped into three parts. Each trail includes a travelable first part 40. Each first part is connected with adjacent travelable first parts of adjacent trails. Each trail includes a non-travelable second part 42. Each trail also includes a non-travelable third part 44. The first part is formed of twenty-four spaced indentations beginning with an indentations of the first part designated and marked as a starting space 46 and with the remaining indentations of the first part sequentially numbered from 1 to 23, respectively, and marked as such. The second part 42 is formed of four indentations and is designated as a holding area for the four game pieces of the associated set. The third part 44 is also formed of four indentations and is designated as a home area for the four game pieces of the associated set. To begin the game, the four game pieces of the associated set are positioned in the holding area. When a player completes the game, the four game pieces of the associated set are positioned in the home area. Each indentation 38 of each trail is formed with a generally concave or hemispherical shape sized for removably holding a game piece 10 therein, thus preventing a game piece from rolling around on the game board and disrupting play.

The back surface of the game board also includes a circuitous path disposed thereon. This path is structured similarly to the path on the front surface of the game board except that it is formed of four elongated adjacent trails 36 instead of six. These trails are similarly disposed on the back surface of the game board in a general end-to-end configuration. The four trails accommodate play by four players or two teams. The structure and function of each trail on the back surface is the same as each trail on the front surface. The structure and function of the indentations on the back surface are also the same as those on the front surface.

The game board further includes a handle 50. The handle is formed of an elongated slot disposed through one of the primary wings of the game board. The slot is sized to accommodate a person'hand. The handle allows the game board to be carried from one location to another.

The game board also includes two elongated grooves disposed thereon. One groove 52 is disposed on the front surface of the game board. The other groove 54 is disposed on the rear surface of the game board. Each groove is extended around the respective surface at a location adjacent to the periphery. Each groove generally encloses the respective path. Each groove prevents game pieces 10 from rolling off the respective surface when game pieces are inadvertently or intentionally dislodged from an indentation during play or when the game board is tilted.

The third major component is the decks of playing cards 60. The present invention includes two decks of playing cards. One deck of playing cards is used for play by four players. Two decks of playing cards are used for play by six players. The decks of playing cards are conventional in design and commercially available. Each deck has fifty-four playing cards. The cards of each deck include four suits of hearts, diamonds, clubs, and spades and also include two jokers. Each suit further has thirteen cards. Nine of the thirteen cards in each suit are sequentially numbered from 2 to 10, respectively. The remaining four cards of each suit are designated and marked as a jack, a queen, a king, and an ace, respectively.

The fourth major component is the rule book 70. The rule book describes the rules of play. The rules are used to control the conduct of play. The rules of the game are set forth as follows:

RULE BOOK

1. The game is played with cards and marbles. It is a partner game.

2. The purpose of the game is to start your marbles at the starting point and go around the board and bring them home.

3. With four players, one deck of cards is required and sixteen marbles or four of one color for each player. Cards are dealt; first hand five cards to each player; second and third hands four cards to each player; toss the remaining two cards into a designated discard pile.

4. With six players, two decks of cards are required and twenty-four marbles or four of one color for each player. Cards are dealt, a first hand and second hand five cards to each player; third and fourth hands, four cards to each player.

5. To enter the game, you need a joker, ace or king. If you can not start then you must throw all of your cards into the center of the board. Anytime that you can not move a marble then you throw all of your remaining cards into the discard pile. Cards are face value of numbers shown. Joker is 20 points, ace is 1 point, king is 13 points, queen is 12 points and a jack is 11 points.

6. The number 4 card is always moved backwards; the number 7 card eats all marbles that it passes, even your own marbles. The jack exchanges your marble with any other opponents marble that is not in the initial "start" position. Players can not pass your "start" spot that you have a marble on if it is a "start" marble. The only exception is when a joker is played; it can pass the start spot.

7. A marble is a starter only when it goes from its resting point to the starting point. If the marble is moved out of the starting point and comes back without being thrown off the board, it is not a starter any more and can be passed with any marble.

8. You do not have to go past your 20 point mark unless you desire to. Remember, the jack is always playable by exchanging one of your marbles with another opponent'marble. If you have a card that is playable it must be played.

9. After all your marbles are home you then help your partner to get their marbles home. By playing a card, let your partner decide which marble they want to move. If your partner does not have enough space to move and does not desire to go around the board again you must then throw the rest of your cards into the center of the discard pile.

10. NOTE: A card laid is a card played and may not be taken back.

In summary, the present invention can be played by two or three teams. Each team has two players, and the object of the game is to be the first team to traverse the path on the game board and arrive at the home area. The game board is 24 inches wide and 36 inches long. It has a general rectangular shape formed with a rectangular central area with wings extended out from opposite sides. In the preferred embodiment, the game board is formed of plywood and finished with polyurethane. The front surface of the board is designated for play by six players, while the back surface is designated for play by four players. The surfaces are marked by a series of indentations forming a path that roughly parallels the perimeter of the board. Each player has a home area that is clearly marked. Each of the indentations less the starting space in each trail is numbered sequentially from 1 to 23. Marbles are used as tokens or game pieces. Each player is responsible for moving four of his game pieces around the board. Each set of four game pieces is formed of marbles which are distinctly colored. One or two decks of conventional playing cards are used to determine how each game piece or token is moved. Each game starts by dealing five cards to each player, and then four for each following hand, except for six players, where five cards are given on the first and second hands. A joker, ace, or king is required to move one marble from the home area onto the starting space. If a player can not move, a new hand must be drawn. Certain cards give special powers. Once a player has moved all marbles back to the home area, he can help out his teammate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A board game for allowing teams of two players to compete against each other comprising, in combination:

six sets of four game pieces with each game piece formed of a marble and with the game pieces of a set having a characteristic color and with each set of game pieces having a unique color;

a planar rigid game board having a generally rectangular planar interior portion, a planar peripheral exterior portion formed of a pair of opposed spaced and generally rectangular long wings with rounded corners and a pair of opposed spaced and generally rectangular short wings with rounded corners with the wings integrally coupled about the interior portion and extended outwards therefrom to form a petaloid periphery, a front surface, and a back surface with the front surface further having a circuitous path disposed thereon formed of six elongated adjacent trails, each trail formed of thirty-two spaced indentations having a characteristic color, the indentations of each trail associated with a set of game pieces having the same characteristic color, the indentations of each trail grouped into a travelable first part connected with travelable first parts of adjacent trails, a non-travelable second part and a non-travelable third part, the first part formed of twenty-four spaced indentations beginning with an indentation designated and marked as a starting space and with the remaining indentations of the first part sequentially numbered from 1 to 23, respectively, the second part formed of four indentations and designated as a holding area for game pieces of the associated set, and the third part formed of four indentations and designated as a home area for game pieces of the associated set, each indentation of each trail formed with a generally concave shape sized for removably holding a game piece therein, and the back surface further having a circuitous path disposed thereon formed of a even number of trails wherein the even number of trails on the back surface is less than the number of trails on the front surface;

a handle formed of an elongated slot disposed through one of the primary wings of the game board for allowing the game board to be carried by hand;

two elongated grooves with one groove disposed on the front surface of the game board and the other groove disposed on the rear surface of the game board, each groove extended around the respective surface at a location adjacent to the periphery and generally enclosing the respective path, each groove preventing game pieces from rolling off of the respective surface when game pieces are dislodged from an indentation during play;

two decks of playing cards, each deck having fifty-four playing cards including four suits of hearts, diamonds, clubs, and spades and further including two jokers, each suit further having thirteen cards and with nine of the thirteen cards of each sequentially numbered from 2 to 10, respectively, and with the remaining four cards of each suit designated and marked as a jack, a queen, a king, and an ace, respectively; and a rule book describing rules of play for the board game.

2. A board game comprising:

a plurality of sets of game pieces;

a game board having a front surface and a back surface with each surface further having a circuitous path disposed thereon formed of a plurality of adjacent trails of an even number, each trail associated with a set of game pieces, each trail formed of a plurality of indentations beginning with an indentation designated as a starting space and with the remaining indentations numbered sequentially;

a plurality of decks of playing cards; and a rule book describing rules of play for the board game.

3. The board game as set forth in claim 2 wherein each game piece is formed of a marble.

4. The board game as set forth in claim 2 wherein the game pieces of each set have a characteristic color and wherein each set of game pieces has a unique color.

5. The board game as set forth in claim 2 wherein the game board has a generally rectangular planar interior portion, a planar peripheral exterior portion formed of a pair of opposed, spaced and generally rectangular long wings and a pair of opposed, spaced and generally rectangular short wings with the wings integrally coupled about the interior portion and extended outwards therefrom to form a petaloid periphery.

6. The board game as set forth in claim 2 wherein the path on the front surface of the game board is formed of six trails.

7. The board game as set forth in claim 2 wherein the path on the back surface of the game board is formed of four trails.

8. The board game as set forth in claim 2 wherein each trail is formed of thirty-two spaced indentations.

9. The board game as set forth in claim 2 wherein the indentations of each trail have a characteristic color and the indentations of each trail are associated with a set of game pieces having the same characteristic color.

10. The board game as set forth in claim 2:

each game piece is formed of a marble; and wherein each indentation of each trail of the game board is sized for removably holding a game piece therein.

11. The board game as set forth in claim 2 further comprising a handle formed of an elongated slot disposed on the game board for allowing the game board to be carried by hand.

12. The board game as set forth in claim 2:

wherein each game piece is formed of a marble; and further including two elongated grooves with one groove disposed on the front surface of the game board and the other groove disposed on the rear surface of the game board, each groove extended around the respective surface at a location adjacent to the periphery and generally enclosing the respective path, each groove preventing game pieces from rolling off of the respective surface when dislodged from an indentation during play.

13. The board game as set forth in claim 2 wherein two decks of playing cards are used.

14. The board game as set forth in claim 2 wherein each deck has fifty-four playing cards including four suits of hearts, diamonds, clubs, and spades and further including two jokers, each suit further having thirteen cards and with nine of the thirteen cards of each sequentially numbered from 2 to 10, respectively, and with the remaining four cards of each suit designated as a jack, a queen, a king, and an ace, respectively.

15. The board game as set forth in claim 2 wherein each trail further includes a first plurality of indentations designated as a holding area for game pieces of the associated set and a second plurality of indentations and designated as a home area for game pieces of the associated set.

16. The board game as set forth in claim 2:

wherein the remaining indentations of each trail number twenty-three; and wherein the remaining indentations of each trail are numbered from 1 to 23, respectively.

* * * * *